US009033789B2

(12) United States Patent
Cowan et al.

(10) Patent No.: US 9,033,789 B2
(45) Date of Patent: May 19, 2015

(54) APPARATUS AND METHOD FOR CONTROLLING PRIZE FUNDS WON BY A USER IN A GAMING SYSTEM

(75) Inventors: Stephen Cowan, New South Wales (AU); Dean Wright, New South Wales (AU); Alan Minski, New South Wales (AU)

(73) Assignee: Paltronics Australia Pty Limited, New South Wales (AU)

( * ) Notice: Subject to any disclaimer, the term of this patent is extended or adjusted under 35 U.S.C. 154(b) by 1374 days.

(21) Appl. No.: 12/083,860

(22) PCT Filed: Oct. 16, 2006

(86) PCT No.: PCT/AU2006/001530

§ 371 (c)(1),
(2), (4) Date: Apr. 18, 2008

(87) PCT Pub. No.: WO2007/045020

PCT Pub. Date: Apr. 26, 2007

(65) Prior Publication Data

US 2009/0124356 A1 May 14, 2009

(30) Foreign Application Priority Data

Oct. 19, 2005 (AU) ..... 2005905783
Apr. 28, 2006 (AU) ..... 2006902219

(51) Int. Cl.
*A63F 9/24* (2006.01)
*G07F 17/32* (2006.01)

(52) U.S. Cl.
CPC ..... *G07F 17/3227* (2013.01); *G07F 17/32* (2013.01)

(58) Field of Classification Search
USPC ..... 463/16–20, 25, 28, 42
See application file for complete search history.

(56) References Cited

U.S. PATENT DOCUMENTS 5,096,195 A 3/1992 Gimmon
5,470,079 A 11/1995 LeStrange et al.

(Continued)

FOREIGN PATENT DOCUMENTS

AU 2003246319 A1 10/2003
CA 2359127 4/2002

(Continued)

OTHER PUBLICATIONS

Australian Patent Office. International Search Report dated Jan. 8, 2007. International Application No. PCT/AU2006/001530. 4 pages.

*Primary Examiner* — Steve Rowland
(74) *Attorney, Agent, or Firm* — Sterne, Kessler, Goldstein & Fox P.L.L.C.

(57) ABSTRACT

Apparatus and methods for controlling prize funds won by a user in a gaming system are disclosed. The apparatus includes a credit meter memory (1) for storing data indicative of an amount of credit available to a user to be played on a primary game, a won funds meter (2) for storing data indicative of a value of funds won by the user in playing a primary or secondary game, a prize message receiver (3) for receiving a message indicative of a quantum of a prize won by the user, a processor (4) responsive to the prize message receiver for modifying the stored data to augment the value of funds by quantum of the prize, a user input message receiver (13) for receiving a message indicative of the user's desire to use at least a portion of the funds won by the user as a stake for a tertiary game; and a tertiary game interface (14) for communicating with a tertiary game controller (12).

29 Claims, 3 Drawing Sheets

(56) References Cited

U.S. PATENT DOCUMENTS

| | | | | |
|---|---|---|---|---|
| 5,749,785 | A * | 5/1998 | Rossides | 463/25 |
| 6,077,162 | A * | 6/2000 | Weiss | 463/26 |
| 6,312,332 | B1 * | 11/2001 | Walker et al. | 463/23 |
| 6,375,567 | B1 | 4/2002 | Acres | |
| 6,416,408 | B2 * | 7/2002 | Tracy et al. | 463/16 |
| 6,648,753 | B1 * | 11/2003 | Tracy et al. | 463/16 |
| 6,860,810 | B2 | 3/2005 | Cannon et al. | |
| 7,713,121 | B1 * | 5/2010 | Luciano et al. | 463/25 |
| 2001/0019965 | A1 | 9/2001 | Ochi | |
| 2002/0107066 | A1 * | 8/2002 | Seelig et al. | 463/20 |
| 2002/0151353 | A1 * | 10/2002 | Gauselmann | 463/25 |
| 2003/0083127 | A1 | 5/2003 | Weiss | |
| 2003/0092483 | A1 | 5/2003 | Bennett et al. | |
| 2004/0038730 | A1 | 2/2004 | Suda | |
| 2004/0106448 | A1 * | 6/2004 | Gauselmann | 463/25 |
| 2004/0204235 | A1 * | 10/2004 | Walker et al. | 463/29 |
| 2005/0020340 | A1 | 1/2005 | Cannon | |
| 2005/0215311 | A1 | 9/2005 | Hornik et al. | |
| 2005/0215313 | A1 * | 9/2005 | O'Halloran | 463/26 |
| 2006/0014582 | A1 * | 1/2006 | Harris et al. | 463/25 |
| 2009/0253483 | A1 * | 10/2009 | Pacey et al. | 463/20 |

FOREIGN PATENT DOCUMENTS

| | | |
|---|---|---|
| DE | 4036728 | 5/1992 |
| WO | WO 2005107912 | 11/2005 |

* cited by examiner

APPARATUS AND METHOD FOR CONTROLLING PRIZE FUNDS WON BY A USER IN A GAMING SYSTEM

CROSS-REFERENCE TO RELATED APPLICATIONS

This application is a U.S. National Stage entry of International Patent Application No. PCT/AU2006/001530, filed on Oct. 16, 2006 by COWAN, Stephen et al. entitled APPARATUS AND METHOD FOR CONTROLLING PRIZE FUNDS WON BY A USER IN A GAMING SYSTEM, the entire contents of which is incorporated by reference, and for which priority is claimed under 35 U.S.C. §371. As in the parent International Application No. PCT/AU2006/001530, priority is also claimed to Australia Patent Application No. 2005905783 filed on Oct. 19, 2005 and to Australia Patent Application No. 2006902219 filed on Apr. 28, 2006, the entire contents of which is incorporated by reference and is claimed under 35 U.S.C. §119.

The present invention relates to a system and method for controlling prize funds won by a user in a gaming system. In particular, the invention relates to gaming apparatus, a method of providing a game, a gaming machine and a gaming network.

The invention has been developed primarily for use with a plurality of interlinked gaming machines in a gaming establishment and will be described with reference to this application. However, the invention is not limited to that particular field of use and is also suitable for use with online gaming, gaming machines that are distributed over a plurality of gaming establishments, lotto, pools, lotteries, art unions, bingo, raffles and other games involving one or more wagers being placed on an outcome having a finite probability of occurring.

BACKGROUND

The discussion of prior art within this specification is to assist the addressee to understand the invention and is not an admission to the extent of the common general knowledge in the field of the invention and is included without prejudice.

It is known to link gaming machines to provide a number of additional functionalities. This includes the ability to control the awarding of a prize, as the pool of funds is greater and the amount of funds available is known rather than having to be estimated. Another known purpose of interlinking gaming machines is to provide secondary gaming such as a linked jackpot. In such a system, a central display typically provides the players with a visual indication of a presently available jackpot prize which is increased incrementally as the players operate the interlinked gaming machines. It is known by the players that the prize will be awarded when it reaches a secret, randomly selected value that is less than a predetermined limit value. The limit value is often also visually indicated to the players by means of the display.

The use of such functionality is intended to attract players to play the machines in the hope of winning the jackpot. However, with the increased sophistication of players and their increased exposure to such systems, the systems' ability to maintain players' interest has diminished.

It is an object of the present invention to overcome, or at least substantially ameliorate, one or more of the disadvantages of the prior art or at least to provide a useful alternative.

SUMMARY OF THE INVENTION

A first aspect of the invention provides gaming apparatus including:

credit meter memory for storing data indicative of an amount of credit available to a user to be played on a primary game;

won funds memory for storing data indicative of the value of funds won by the user;

a prize message receiver for receiving a message indicative of the quantum of a prize won by the user; and a processor responsive to the prize message receiver for modifying the data indicative of the value of funds won.

Preferably, the prize message receiver is adapted to receive a message from a secondary game controller.

Additionally or alternatively, the prize message receiver may be adapted to receive a message from a primary game controller.

The prize message receiver may still further additionally or alternatively be adapted to receive a message from a tertiary game controller.

The gaming apparatus preferably further includes:

a user input message receiver for receiving an indication of the user's desire to use at least a portion of the funds won as a stake for a tertiary game; and a tertiary game interface responsive to the user input message receiver for communicating with a tertiary game controller.

Preferably, the credit meter memory is located in or adjacent a gaming machine operable by a user.

In one embodiment, the won funds memory is located in or adjacent the gaming machine.

In an alternative, the gaming apparatus preferably further includes a secondary game controller, for example remote from the gaming machine, and the won funds memory is located in or adjacent the secondary game controller.

Preferably, the gaming apparatus further includes in or adjacent the gaming machine a user input device in communication with the user input message receiver.

Preferably, the tertiary game interface is located in or adjacent the gaming machine.

The gaming apparatus preferably further includes a payout device in communication with the user input device and responsive thereto to payout all or a user-selected amount of the won funds.

A second aspect of the invention provides a method of providing a game including the steps of:

storing in a first memory location data indicative of an amount of credit available to a user to be played on the primary game;

storing in a second memory location data indicative of the value of funds won by the user;

when a prize is worn by a user modifying the data in the second memory location to augment the value of finds won by the quantum of the prize won.

Preferably, the data is modified in response to a prize won in a secondary game.

Additionally or alternatively, the data is modified in response to a prize won in the primary game.

Further, the data may be modified in response to a prize won in a tertiary game.

The method preferably further includes:

receiving a tertiary game message indicative of the user's desire to use at least a portion of the funds won as a stake for a tertiary game; and communicating with a tertiary game controller in response to the tertiary game message to cause the tertiary game controller to provide the tertiary game using the user selected stake.

The method preferably further includes, receiving a user indication of a desire to pay out all or a user-selected amount of the won funds, and responding by paying out the won funds or the user-selected amount of won finds.

A third aspect of the invention provides a gaming machine including:

credit meter memory for storing data indicative of an amount of credit available to a user for play on a primary game provided by the gaming machine; and won funds memory for storing data indicative of the value of finds won by the user.

Preferably, the won funds memory is located on a network interface card associated with the gaming machine.

A fourth aspect of the invention provides a gaming network including a plurality of gaming machines as set out above, and a centralised secondary game controller for providing a secondary game having a secondary game prize, the secondary game controller being adapted to determine which of the gaming machines has won the secondary game prize and to output a secondary game prize message to the winning gaming machine, indicating the quantum of the secondary game prize.

Preferably, each of the gaming machines is adapted to respond to a message from the secondary game controller indicating that it has won the secondary game by modifying the data indicative of the value of funds won.

The gaming network preferably further includes a tertiary game controller.

The tertiary game controller is preferably adapted to offer a tertiary game to the user of a gaming machine storing data indicative of a non-zero amount of funds won.

The tertiary game may be offered periodically, at random intervals, in response to the occurrence of predetermined events or at intervals determined in dependence upon the value of funds won.

Preferably, the gaming network includes a respective tertiary game controller associated with and adjacent to each gaming machine.

A fifth aspect of the invention provides a gaming network including:

a plurality of gaming machines each having an associated won finds memory for storing data indicative of the value of fends won by a respective player;

a secondary game controller in communication with said gaming machines for providing a secondary game having a secondary game prize, the secondary game controller being capable of determining a set of gaming machines and modifying the won funds memories of the gaming machines within the set so as to share the secondary game prize amongst the gaming machines within the set; and a tertiary game controller for offering a tertiary game to the players of the gaming machines within said set.

In one preferred embodiment the set is a sub-set of said plurality of gaming machines. Preferably the sub-set is defined by the gaming machines that participated in the secondary game. In another embodiment the sub-set is defined by the currently active gaming machines at a time of the award of the secondary game prize.

Preferably the teary game includes an option allowing a player of a gaming machine within the set to offer a bet to players of other gaming machines. Preferably the other gaming machines are remaining gaming machines within the set. In a preferred embodiment a stake for the bet is provided by all or a portion of the funds indicated by the won funds memory. In another preferred embodiment a stake for the bet is provided by all or a portion of the secondary game prize.

A sixth aspect of the invention provides a gaming network including:

a plurality of gaming machines in communication with a secondary game controller for providing a secondary game having a secondary game prize, the secondary game controller being capable of sharing the secondary game prize amongst a set of gaming machines; and a tertiary game controller for offering a tertiary game to the players of the gaming machines within the set, said tertiary game including an option allowing a player of a gaming machine within the set to offer a bet to players of other gaming machines.

Preferably a stake for the bet is provide by all or a portion of the secondary game prize.

A seventh aspect of the invention provides a gaming method including the steps of.

providing a plurality of gaming machines, each of said gaming machines being capable of executing a primary game, each of said gaming machines being communicatively connectable to a central controller for the provision of a secondary game;

using the central controller to determine a set of winning gaming machines and to share a secondary game prize amongst the gaming machines within said set; and using the central controller to provide an option at each of the gaming machines within the set to participate in a tertiary game.

In one embodiment, the tertiary game consists of a bet offered by a player of a gaming machine within the set to other players of other gaming machines. In another embodiment the tertiary game consists of a bet offered by a player of a gaming machine within the set exclusively to other players of other gaming machines within the set.

Further aspects of the invention provide computer programs for causing a computer to implement a method as set out above, a data carrier carrying data representing such a computer program, a signal carrying data representing such a computer program, and a computer programmed to execute such a computer program.

BRIEF DESCRIPTION OF THE DRAWINGS

Preferred embodiments of the invention will now be described, by way of example only, with reference to the accompanying drawings, in which.

DETAILED DESCRIPTION

Figure 1:
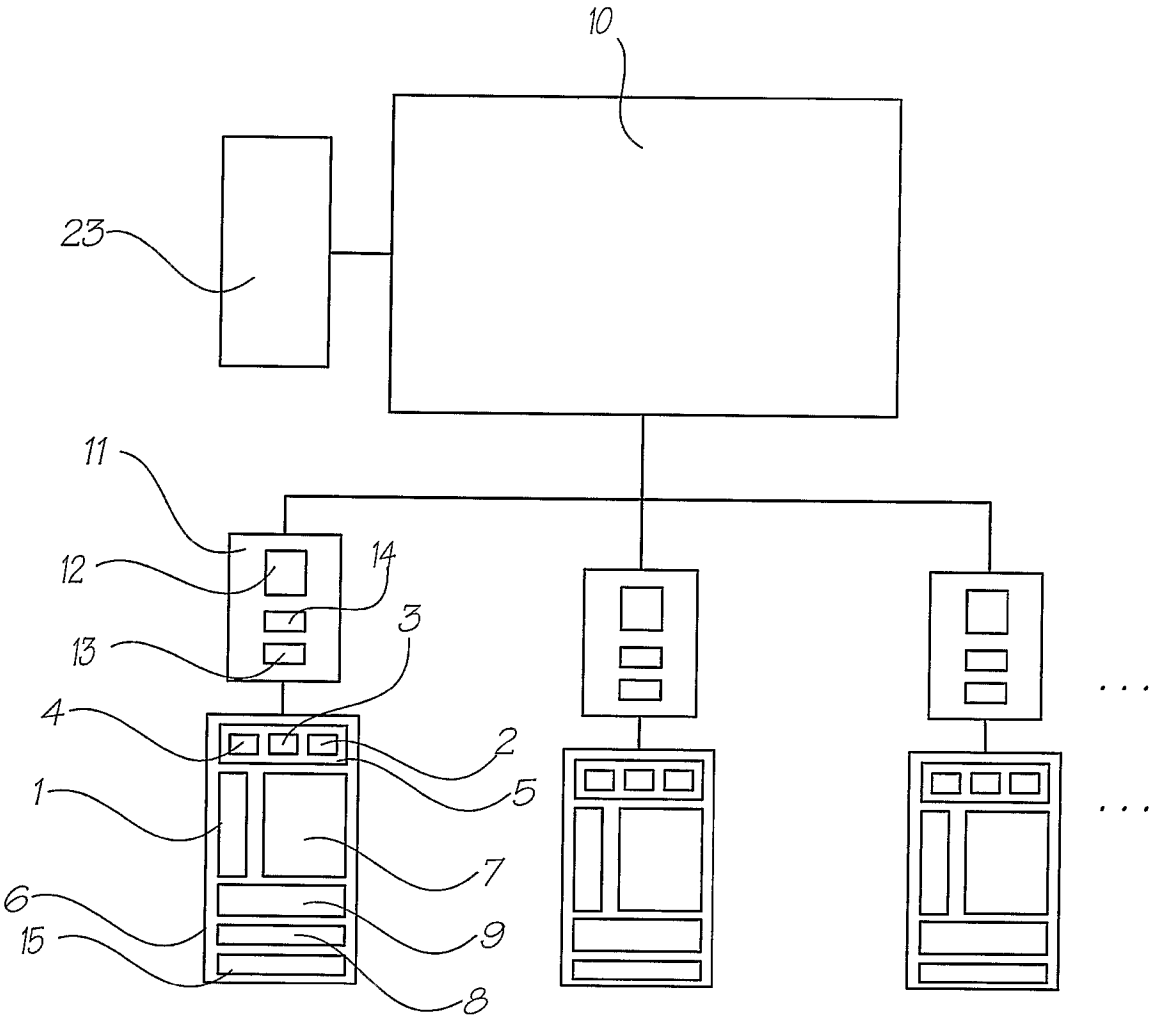
FIG. 1 is a schematic view of a first gaming apparatus according to the invention.

FIG. 1 shows gaming apparatus including credit meter memory 1 for storing data indicative of an amount of credit available to a user to be played on a primary game, won funds memory 2 for storing data indicative of the value of funds won by the user; a prize message receiver 3 for receiving a message indicative of the quantum of a prize won by the user, and a processor 4 responsive to the prize message receiver for modifying the data indicative of the value of funds won.

The won funds memory 2, the prize message receiver 3, and the processor 4 are located in a network interface card 5 in a gaming machine 6. The gaming machine 6 also includes primary logic 7 for providing a primary game to a user, a user input device 8 to allow a user to make selections and provide input to games, and a screen 9 for providing a user with information relating to games.

In the embodiment shown, the gaming machine 6 is one of a plurality of machines in communication with a secondary game controller 10 for the provision of a secondary game of a known type such as a linked jackpot.

Each of the gaming machines has physically located adjacent to it and in communication with it a respective tertiary game module 1. The tertiary game module is operable for the provision of tertiary games to the user of the gaming machine 6 using as a stake a proportion of the funds represented by the data stored in the won funds memory 2 as discussed in greater detail below.

The prize message receiver 3 of a particular gaming machine 6 is adapted to receive a message from the primary logic 7, the secondary game controller 10, or the tertiary game module 11 when it is determined that that gaming machine 6 has won a prize in the first game, the secondary game, or the tertiary game respectively. The prize message receiver 3 extracts from the message data indicative of the quantum of the prize, and the processor 4 modifies the data stored in the won funds memory 2 to effect addition of the prize won to the previously stored value. In alternative embodiments, prizes won on the primary game are not added to the won funds meter but are paid instead to the credit meter of the gaming machine 6. In any event, the won funds meter represents funds which have been won by the user, rather than funds which have been added to the gaming machine credit meter by the user.

The tertiary game module 11 includes a tertiary game controller 12 and a user input message receiver 13 for receiving an indication of a user's desire to play a tertiary game. The user input-message receiver communicates with the tertiary game controller 12 via a tertiary game interface 14.

In an alternative embodiment (not shown) the tertiary game controller and other features of the tertiary game module are located on the network card of the gaming machine, and the tertiary game is provided by the interface card. In further embodiments the secondary game is also provided by the interface card.

When the user wishes to play a tertiary game, he indicates this by appropriate operation of the user input device, and the user input message receiver 13 receives an indication of the user's desire to use at least a portion of the funds won as a stake for a tertiary game. In one embodiment, this message receiver itself takes the form of a user input device on or adjacent the tertiary game module directly operable by the user. In another embodiment, the message receiver is an electronic device for receiving a message from the gaming machine 6 in response to user operation of the gaming machine user input device 8. In yet a further embodiment in which the tertiary game is provided by the interface card, the message receiver takes the form of a user input device on or adjacent the interface card in or associated with the gaming machine.

The gaming machine 6 further includes a payout device 15 in communication with the user input device and responsive thereto to pay out all or a user-selected amount or proportion of the won funds in a known manner. For example payment may be made from a local cash hopper, finds permitting, or by payment to an account or a smartcard, by issuing of a voucher which may be redeemable at a cashier, etc. In one embodiment, won funds are paid from the won funds meter directly. In another embodiment, won funds may only be paid out after having been transferred from the won finds meter to the credit meter.

Figure 2:
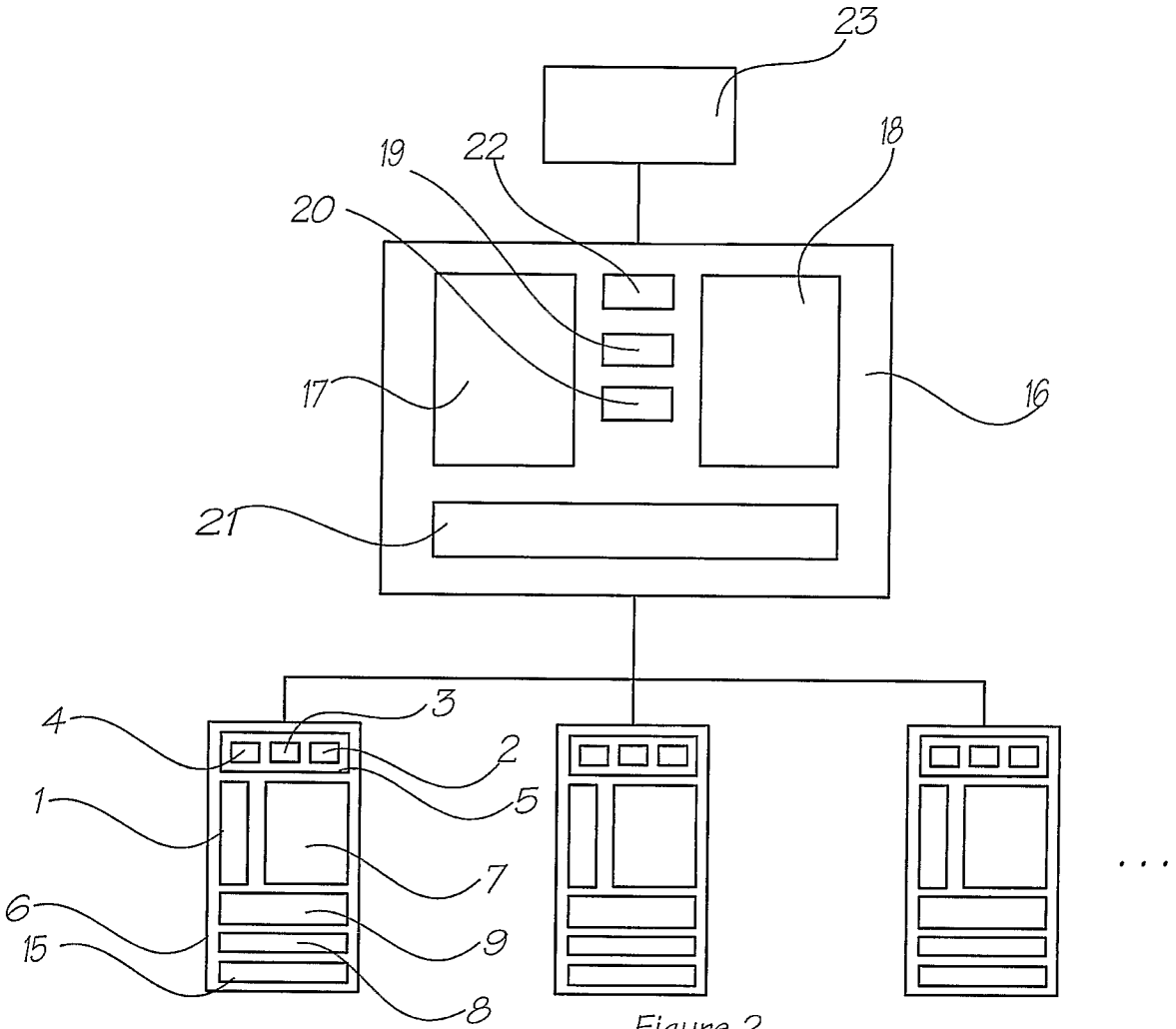
FIG. 2 is a schematic view of a second gaming apparatus according to the invention.

In the embodiment shown in FIG. 1, the won funds memory 2 is located in the gaming machine 6, and a respective tertiary game controller is associated with each gaming machine 6. FIG. 2, however, shows an alternative embodiment in which the secondary and tertiary games are both administered centrally.

The gaming apparatus shown in FIG. 2 again includes a plurality of gaming machines 6 for providing respective users with a primary game. A central server 16 is provided which includes a secondary game controller 17 and a tertiary game controller 18 which share memory 19, a comparator 20 and an interface card 21, by which the server communicates with the gaming machines. The central controller also includes a display controller 22 for causing a display screen 23 to show information relating to the secondary and tertiary games. The memory 19 stores respective data indicative of the value of funds won by the users of each of the gaming machines on the secondary and tertiary games.

In this embodiment, prizes won on the primary game of a gaming machine are paid to the credit meter of that gaming machine. However, when a prize is won on the secondary game by the user of a gaming machine, the secondary game controller 17 modifies the prizes won data associated with that gaming machine to augment the value of funds won by the quantum of the prize. Similarly, when a prize is won on the tertiary game by the user of a gaming machine, the tertiary game controller 18 modifies the prizes won data associated with that gaming machine to augment the value of funds won by the quantum of the prize.

In one embodiment, tertiary gaming is available at any time to a user having funds in the funds won meter represented by data in the memory 19. In alternative embodiments, the opportunity to play a tertiary game is given periodically, at random, or in response to an event such as a win on a secondary game.

In the preferred embodiment, the secondary game is a linked jackpot game, in which the jackpot is awarded in an event-dependent manner, for example when an accrued turnover amount reaches a predetermined threshold. Such a system is disclosed in copending PCT application no. PCT/AU2004/001444, which is incorporated by reference below. In this kind of system, the secondary game controller 17 also stores in memory 19 data indicative of a predetermined jackpot value and of an accrued prize value. The secondary game controller 17 adjusts the accrued prize value in response to messages received from the gaming machines indicative of gaming activity at the gaming machines. The comparator 20 compares the accrued prize value and the predetermined jackpot value. The secondary game controller 17 responds to the comparator by awarding the secondary game prize when the accrued prize value reaches the predetermined jackpot value.

However, in an alternative embodiment, the linked jackpot is awarded in a time-dependent manner. In such a system, the messages from the gaming machines 6 serve to notify the secondary game controller 17 of which gaming machines 6 are active and therefore eligible to receive the linked jackpot.

In yet a further alternative embodiment, in which the linked jackpot is awarded in an event-driven manner, the gaming machines 6 indicate to the secondary game controller 17 that a linked jackpot should be awarded when a particular event arises on a gaming machine, for example three kings showing on a poker game.

When an opportunity to play a tertiary game is triggered, the tertiary game controller sends a message to the appropriate gaming machine or machines, which alert their respective users to the opportunity by displaying appropriate information on their display screens 9.

The user of a gaming machine at which a tertiary game is available, whether by virtue of having been triggered in some embodiments, or simply because funds exist in the won funds meter in other embodiments, may accept or reject the tertiary game by operation of the user input devices 8. In a particularly preferred embodiment, the gaming machine input devices 8 allow the users to indicate a proportion or an amount of their funds won to be used as the tertiary game stake.

Particular examples of tertiary games will now be described with reference to FIGS. 2 and 3. In one example, the tertiary game is a game of chance having two possible outcomes, for example high-low. The payouts are nil for a lose and two times stake for a win. In the event of a win, the user is given an opportunity to repeat the tertiary game, in this example using the prize from the win as the stake for the next iteration. Thus a tertiary game session may include one or more iterations, depending upon the outcome of iterations of the game and upon user selections.

The tertiary game controller 18 stores in memory 19 counter data indicative of the number of iterations of the tertiary game that have been executed in a particular tertiary game session, a predetermined limit value indicative of the maximum number of iterations per tertiary game session, and at least one bonus prize value indicative of iteration numbers at which a bonus prize will be awarded to the user. The memory 19 also stores data indicative of the current prize value. The present example will be described with a limit value of 5 and a bonus values of 3 and 5. That is to say that if a user wins the tertiary game three times consecutively, a bonus prize is awarded, and if the user wins the tertiary game five times consecutively, a further bonus prize is awarded and the tertiary game session is terminated.

When the user of a gaming machine operates the user input device of the gaming machine to indicate that he wishes to play a tertiary game with a stake of, say $10, the gaming machine 6 sends a message to the tertiary game controller. The tertiary game controller and the gaming machine are operable in a known manner to ensure that the selected stake is no greater than the value of finds available.

Figure 3:
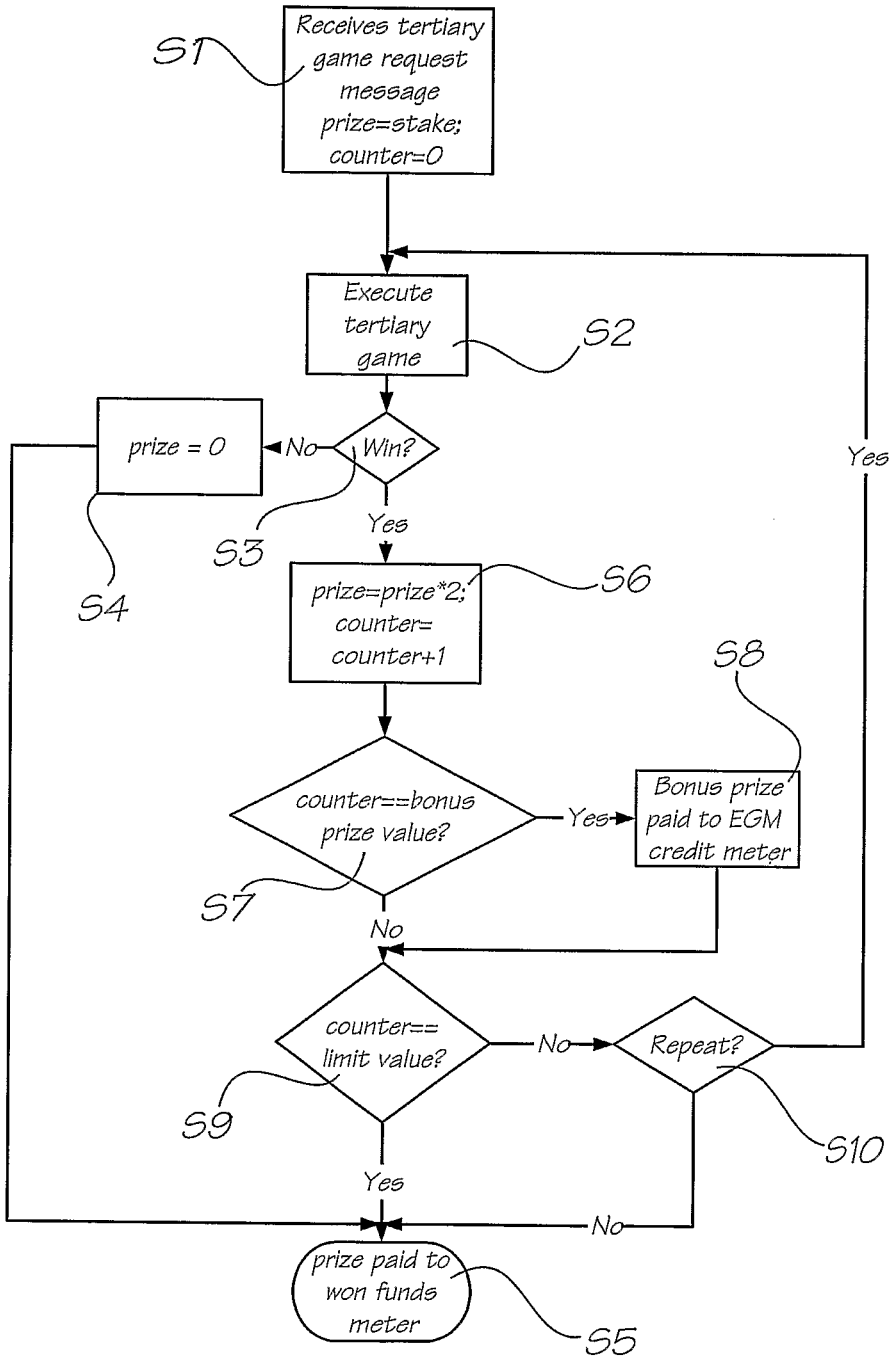
FIG. 3 is a flowchart illustrating a method of operating a gaming apparatus.

The tertiary game controller responds, at step S1 of FIG. 3, by storing the stake value as the current prize value, and by initialising the counter to zero.

At step S2 the tertiary game is executed by the tertiary game controller, taking user input where necessary, for example to choose "higher" or "lower", etc.

The tertiary game controller check at step S3 whether the game has been won. If not, the tertiary game controller modifies the data indicative of the prize at step S4 to indicate that the prize is nil. Control then passes to step S5 where the prize (in this case, nil) is added to the won funds meter as described above, and the tertiary game session terminates. If the game has been won, the stored prize value is doubled and the counter is incremented at step S6.

At step S7, the comparator 20 then compares the counter with the bonus prize values. If the counter equals either of the values, that is in the present case if the tertiary game has been won 3 or 5 times, a bonus prize is added, at step S8, to the EGM credit meter or the funds won meter as discussed above. The amount of the bonus prize is predetermined and may be stored for example in the memory 19. At step S9, the comparator then compares the counter with the predetermined limit value. If the counter equals the limit value, that is in the present case if the tertiary game has been won 5 times, the currently stored prize value is paid to the won funds meter at step S5 and the tertiary game session is terminated. If the counter is not equal to the limit value, that is if the tertiary game has been won fewer than 5 times, the user is presented, at step S10 with the option to repeat the tertiary game. If the user elects not to repeat, the currently stored prize value is paid to the won funds meter at step S5 and the tertiary game session is terminated. If the user decides that he or she does wish to repeat the tertiary game, flow returns to step S2 and the tertiary game is executed again.

It will be noted that in some embodiments, the data indicative of the credit meter of a gaming machine and the data indicative of the funds won on a gaming machine are physically separated from one another (for example, the former being in the main memory space of a gaming machine and the latter being in the memory space of a central gaming server or of an interface card in or associated with the gaming machine). In other embodiments, the values are stored in the same device, and physical memory device. However, in all embodiments, they are stored in such a way as to be distinguishable from one another.

In each of the above embodiments, the display controller 22 causes the display screen 23 to show information relating to the secondary game, e.g. a linked jackpot game. In some embodiments in which tertiary game information is provided on a screen local to a gaming machine 6 at which a tertiary game is being played, for example the embodiment described with reference to FIG. 1, information specific to the tertiary game is only displayed on the tertiary game display 9 associated with that gaming machine. However, in alternative embodiments, to encourage further interest in the gaming system, the display controller 22 also causes the central display screen 23 to display information relating to the tertiary game including, for example, information relating to a user's decision to play the tertiary game, information relating to a user's decision as to the value of stake and information relating to whether or not the tertiary game is won or lost. Some embodiments of the invention are provided in a single gaming establishment in which the user-operable terminals are gaming machines at the establishment. In alternative embodiments, the gaming machines are distributed among a number of such establishments or other locations and/or include other devices such as personal computers. In such latter cases, communication between the machines and the secondary game controller (and the tertiary game controller when centralised) is effected for example by means of an existing network, such as the internet, or by telephone dial-up or radio communication or by a combination of the above.

Another example of a tertiary game may be implemented on the apparatus shown in FIG. 2. In this example, the gaming network includes 10 gaming machines 6. Each of the machines 6 has an associated won funds memory 2 for storing data indicative of the value of funds won by the players of each machine.

The secondary game controller 17 provides a secondary game having a secondary game prize of $160.54. As in the previous example, the secondary game is of the linked jackpot type, although other types of secondary games may be utilised. The secondary game controller 17 is capable of determining a set of the gaming machines amongst which to share the secondary game prize. This determination is in accordance with rules that define the secondary game. In various preferred embodiments the set of winning gaming machines is defined by any one or more of the following:

- the plurality of gaming machines;
- a sub-set of the plurality of gaming machines;
- a predefined number of gaming machines that satisfy predefined criteria, such as those that contributed funds towards the secondary game immediately prior to the award of the secondary game prize, or those that contributed the highest amount of funds towards the secondary game within a given period;
- the set of currently active gaming machines at the point in time at which the secondary game prize is awarded; or
- a random or pseudo-random selection.

For the sake of the present example, it is assumed that the secondary game prize is shared among the set of currently active gaming machines at the point in time at which the secondary game prize is awarded. For this example, it is assumed that four gaming machines 6 were active at that time.

Once the winning set of gaming machines 6 is selected by the secondary game controller 17, the won funds memories 2 of the gaming machines within the winning set are modified so as to share the secondary game prize between the set of gaming machines. This commences with calculation by the processor of the secondary game controller 17 of the amount to be awarded to each gaming machine 6. For this calculation, the total prize is divided by the number of winning gaming machines. In this example, this amount is $160.54 divided by four, which is $40.135. This amount is rounded up to the nearest denomination of the gaming machines. In this example, the machines 6 have a denomination of 10 cents. Hence, the amount awarded to each gaming machine within the wining set is rounded up to $40.20. This amount is communicated in a message from the secondary game controller 17 to each of the four gaming machines 6 in the winning set. Upon receipt of the message by each of the four gaming machines, the amount is extracted from the message and any pre-existing amount indicated by the data within the won funds memory 2 is incremented by the extracted amount.

The tertiary game controller 18 offers a tertiary game to the players of the gaming machines 6 within the set of gaming machines amongst which the secondary game prize was awarded. The tertiary game includes an option allowing a player of a gaming machine 6 within the set to offer a bet to players of other gaming machines. The bet may be in relation to any outcome that is unknown from the viewpoint of the players. Particularly suited to the invention are those bets on events having two possible outcomes, corresponding to a win or a loss. In the running example the event is a simulated toss of a coin, with two possible outcomes: "heads" or "tails".

In one embodiment, acceptance of the bet is possible by players of all other gaming machines. In another embodiment described in further detail below, the bet is only offered to the remaining gaming machines within the set, such that only recipients of a share of the secondary prize are given the option of accepting the bet. In this example, the option to offer a bet is communicated to the players of the four wing gaming machines via a display on the respective tertiary game modules 11 of those gaming machines.

In one embodiment, the stake for the bet is provided by all or a portion of the funds indicated by the won funds memory. In a preferred, the stake for the bet is provide by all or a portion of the secondary game prize.

In this example, it is assumed that a player of one of the four winning gaming machines 6 offers a bet of half the amount won by that player in the secondary game; that is, a bet of $20.10. This player makes a suitable input into the user input device 8 of his gaming machine 6, resulting in a message being sent from that gaming machine 6 to the tertiary game controller 18. The tertiary game controller 18 then communicates the availability of that bet to the gaming machines of the remaining three players among which the secondary prize was shared. The offering of the bet is communicated to the remaining three players via a display on the tertiary game module 11.

In one embodiment, the identity of the player offering the bet is kept anonymous. In another embodiment, the identity of the player offering the bet is communicated to the other players, either by means of a gaming machine identifier, or by means of a previously entered player identifier, such as a name or nick-name.

In one preferred embodiment, only one player may accept any single offered bet. In another embodiment, multiple players may accept any single offered bet, in which case the stake is divided evenly amongst the entities accepting the bet. In yet a further embodiment, an accepting player may specify the amount of the bet he wishes to accept. The player or players wishing to accept the offered bet do so by making a suitable input into their respective user input devices 8. In this example, it is assumed that two players accept the $20.10 bet, and that the bet is divided equally between them. Hence, those two players each stand to win or lose $10.10 (rounded up to the nearest 10 cent denomination), whereas the person offering the bet stands to win or lose $20.10.

Acceptance of the bet is communicated to the tertiary game controller 18. Once a predefined period of time for the offering and acceptance of bets has elapsed, the tertiary game controller 18 proceeds to determine the outcome of the event upon which the bet was placed. In this example the toss of a coin is simulated. Dependent upon the outcome, messages are sent from the tertiary game controller 18 to the relevant gaming machines so as to update the amounts indicated in the respective won funds memories 2 accordingly. In this example, the two players that accepted the bet win. Hence the amount indicated in the won finds memory 2 of the gaming machine 6 used by the player that offered the bet is decremented by $20.10. Correspondingly, the amounts indicated in the won funds memories 2 of the gaming machines 6 used by the two players that accepted the bet are each incremented by $10.10.

Another example of a tertiary game will now be described in an embodiment in which the won funds meters of the gaming machine is stored in memory local to the secondary game controller. In this example, a secondary prize of $100 is shared evenly among five gaming machines 6, resulting in the incrementing of their credit meters by $20 each. The secondary game controller stores the amount $20 in its memory 19, which is accessible by the tertiary game controller 18.

The tertiary game controller 18 offers a tertiary game to the players of the gaming machines within the set; that is to the players of the five winning gaming machines 6. The tertiary game includes an option allowing a player of a gaming machine 6 within the set to offer a bet to players of other gaming machines. The stake for the bet is provide by all or a portion of the secondary game prize. In the running example the tertiary controller 18 accesses memory 19 so as to ascertain that the amount of the stake is $20. The remaining processing of the bet proceeds identically as for the previously described embodiment, with the exception that any amounts won or lost on the bet are incremented or decremented from the players respective credit meters, as opposed to from won funds memories.

In other embodiments, the tertiary game allows for odds betting, with the odds being calculated based upon the number of participants. In a preferred such embodiment, the tertiary game consists of players making a bet on a pseudo-random simulated event having either a black or red outcome. In an example of such a tertiary game, one person bets upon a black outcome, and four people bet upon a red outcome. Hence, if the simulated event outcome is black, then the person who selected black will win odds of 4-1, minus any operator commissions and/or fees. Alternatively, if the simulated event outcome were red, then the four people selecting red would win an equal proportion of the stake from the person offering black, minus any operator commissions and/or fees.

An alternative embodiment has a tertiary game allowing for odds betting, with the odds being calculated based upon the proportions as wagered by the participants on the possible outcomes. In a running example of this embodiment, seven players, labelled A to G respectively, equally share a total secondary prize pool of $2,356.34. When sharing the secondary prize pool amongst the secondary winners, the won funds memories 2 of the gaming machines 6 used by each of the winning participants are incremented by $336.62 and the option to participate in a tertiary game is offered to the seven players.

Each of the players make suitable inputs into their respective gaming machines 6 to indicate whether they wish to participate in the tertiary game and, if so, the amount they are prepared to wager. In the running example all seven secondary winners choose to participate in the tertiary game and the following amounts are wagered on the following outcomes:

| Player | Amount Wagered | Outcome |
|---|---|---|
| A | $100 | Red |
| B | $50 | Red |
| C | $25 | Red |
| D | $100 | Black |
| E | $36.62 | Black |
| F | $36.62 | Red |
| G | $36.63 | Black |

The won funds memories 2 of the seven gaming machines A to G are decremented in accordance with the amounts wagered.

The information in the above table is communicated to the tertiary game controller 18, which performs the following calculations and stores the results in a suitable memory location:

Total amount wagered on Red: $211.62

Total amount wagered on Black: $173.25

Available tertiary prize pool:
$211.62+$173.25=$384.87

Next the tertiary game controller 18 simulates the event, resulting in a red outcome in the running example. Hence, players A, B, C and F are the winners of this tertiary game. The respective proportion wagered by each of the winning players is calculated by the tertiary gaming controller 18 as follows:

Proportion wagered by Player *A*: $100÷$211.62=0.47

Proportion wagered by Player *B*: $50÷$211.62=0.24

Proportion wagered by Player *C*: $25÷$211.62=0.12

Proportion wagered by Player *F*:
$36.62÷$211.62=0.17

These proportions form the basis for calculation by the tertiary controller 18 of the odds and therefore of the tertiary prizes to be awarded to the winning players, as follows:

Tertiary prize to be awarded to player *A*:
0.47×$384.87=$180.89

Tertiary prize to be awarded to player *B*:
0.24×$384.87=$92.39

Tertiary prize to be awarded to player *C*:
0.12×$384.87=$46.18

Tertiary prize to be awarded to player *F*:
0.17×$384.87=$65.43

These tertiary prize amounts are rounded up to the nearest denomination of the gaming machines 6, and the respective won funds memories 2 of the gaming machines 6 used by the tertiary game winners are suitably incremented.

Although this embodiment of the tertiary game has only two possible outcomes, red or black, it will be appreciated that the invention can also be adapted for wagering on events having a larger number of outcomes or on any random or pseudo-random event. Non-limiting examples of suitable events, whether actual or simulated, include:

- a horse races;
- games of keno or bingo;
- card games such as blackjack, poker, baccarat, go fish, old maid, snap, etc;
- casino games, such as roulette, craps etc;
- outcomes of sporting events, such as football matches, the PGA open, etc., or;
- the spin of a reel on a poker machine.

In each of the above examples, one embodiment of the invention provides for the operator of the system to extract revenue that is directly derived from the tertiary and/or secondary gang activities. This can be achieved in numerous ways, including the following non-limiting examples:

- Taking a proportion of the staked amounts and/or a fixed fee from each participant in a secondary or tertiary game;
- Taking a proportion of a prize amount paid to one or more winners of a secondary or tertiary game;
- Taking a proportion of the tertiary prize pool offered to the tertiary game winners; and/or
- Taking a proportion of the secondary prize pool prior to sharing the secondary prize pool amongst the one or more secondary game winners.

Continuing on with the second running example, the operator may derive a revenue stream from the tertiary game by taking 10% of the total amount wagered. In this case, 10% of the total amount wagered amounts to 10% of $384.87=$38.49. The available tertiary prize pool thus becomes $384.87−$38.49=$346.38. The tertiary prize to be awarded to players A, B C and F is then calculated based on the new available tertiary prize pool, as follows:

Tertiary prize to be awarded to player *A*:
0.47×$346.38=$162.80

Tertiary prize to be awarded to player *B*:
0.24×$346.38=$81.13

Tertiary prize to be awarded to player *C*:
0.12×$346.38=$41.57

Tertiary prize to be awarded to player *F*:
0.17×$346.38=$58.88

Yet another embodiment of the invention features a tertiary game offering a progressively incremented jackpot. In one such embodiment, the tertiary jackpot is progressively incremented by diverting a proportion of the total winnings from the primary games into the tertiary jackpot. In an alternative such embodiment, the tertiary jackpot is progressively incremented by diverting a proportion of the total secondary jackpot into the tertiary jackpot. In yet another such embodiment the tertiary jackpot is progressively incremented by diverting a proportion of the total funds made available for tertiary gaming into the tertiary jackpot. At an appropriate juncture, for example once the tertiary jackpot has incremented past a pre-set threshold limit, some or all of the tertiary jackpot is awarded to one or more of the players of the tertiary game based upon a predetermined outcome. An example of such a predetermined outcome is provided by an embodiment in which the tertiary jackpot is incremented by diversion of a proportion of the total funds made available for tertiary gaming and the tertiary jackpot is awarded to the play of the tertiary game that contributed the final diversion of funds required to increment the tertiary jackpot past the pre-set threshold limit.

In some embodiments, the awarding of the tertiary game is not triggered by a jackpot being incremented to a threshold limit. Instead, the tertiary game is triggered by another event relating to gaming. For example, the tertiary game may be triggered by:

the occurrence of a predetermined result in the secondary game such as, for example, a run of a predetermined number (e.g. 5) successful outcomes in the secondary game (e.g. a double-up game);

the occurrence of a predetermined result in the primary game in combination with a predetermined result in the secondary game; or player selection of a tertiary game as the prize (or part of the prize) for a win in the secondary game (whether this selection is a simple player selection, a player selection by operation of the player's skill, or a selection by chance).

Although the invention has been described with reference to specific examples, it will be appreciated by those skilled in the art that it may be embodied in many other forms. In particular features of any one of the various described examples may be provided in any combination in any of the other described examples.

In further embodiments, systems according to the invention are provided in, or in combination with, the systems disclosed in copending Australian patent application numbers 2005901326, 2004906409, PCT patent applications numbers: PCT/AU2004/001444, PCT/AU2005/000670, PCT/AU2005/000668, PCT/AU2005/001473, PCT/AU2005/000659, PCT/AU2005/000669, PCT/AU2005/000615, and PCT publication numbers WO 2005/008514 A1, WO 2005/083599 A1, the full contents of each of which is herein incorporated by reference.

Furthermore, the functionality of various components—such as the secondary game controller and the tertiary game controller—have been described as being performed by distinct devices, such as dedicated integrated circuits. However, in preferred embodiments, all or any combination of their functionality is instead performed by multi-purpose integrated circuits or implemented in software executed on a microprocessor. Particularly in such cases, the invention is additionally embodied in a computer program or in a computer program in a data signal or stored on a data carrier.

The claims defining the invention are as follows:

1. An apparatus for controlling prize funds won by a user in a gaming system, the apparatus comprising:

a primary logic module configured to provide a local game, wherein the user is enabled to participate in the local game, a linked jackpot game provided by a linked jackpot controller, and a stake-based game provided by a stake-based game controller;

a credit meter configured to store data indicative of an amount of credit available to the user to be played in the local game;

a prize message receiver configured to receive a message from each of the primary logic module, the linked jackpot controller, and the stake-based game controller when it is determined that the user has won a prize in each of the local game, the linked jackpot game, and the stake-based game, wherein the prize message receiver is further configured to extract, from the received message, data indicative of the prize won by the user;

a won funds meter configured to store data indicative of a value of funds won by the user in playing each of the local game, the linked jackpot game, and the stake-based game;

a processor configured to modify the data stored in the won funds meter to effect addition of the prize on by the user to a previously stored value such that the won funds meter represents the funds won by the user rather than funds which have been added to the credit meter;

a user input message receiver configured to receive a message indicative of a desire of the user to use at least a portion of the funds won by the user as a stake for the stake-based game the stake-based game being distinct from the local game and the linked jackpot game, and to transfer any remainder of the funds won by the user not used as the stake to the credit meter; and a stake-based game interface configured to communicate with the stake-based game controller to allow the at least the portion of the funds won by the user to be used as the stake in the stake-based game.

2. The apparatus according to claim 1, wherein the credit meter is located in or adjacent to a gaming machine operable by the user.

3. The apparatus according to claim 2, wherein the won funds meter is located in or adjacent to the gaming machine.

4. The apparatus according to claim 2, wherein the won funds meter is located in or adjacent to the linked jackpot game controller.

5. The apparatus according to claim 4, wherein the linked jackpot game controller is remote from the gaming machine.

6. The apparatus according to claim 2, further comprising:

in or adjacent to the gaming machine, a user input device in communication with the user input message receiver.

7. The apparatus according to claim 2, wherein the stake-based game interface is located in or adjacent to the gaming machine.

8. The apparatus according to claim 7, further comprising:

a payout device, in communication with a user input device and responsive thereto, configured to payout all or a user-selected amount of the funds won by the user.

9. A computer-implemented method of providing a game in a gaming system, the method comprising:

enabling a user to participate in a local game provided by a primary logic module of a local gaining machine, a linked jackpot game provided by a linked jackpot controller, and a stake-based game provided by a stake-based game controller;

storing, in a first computer memory location, data indicative of an amount of credit available to a user to be played on the local game;

receiving, at a prize message receiver, a message from each of the primary logic module, the linked jackpot controller, and the stake-based game controller when it is determined that the user has won a prize in each of the local game, the linked jackpot game, and the stake-based game;

storing, in a second computer memory location, data indicative of a value of funds won by the user;

extracting, from the prize message receiver, the received message data indicative of the prize won by the user;

modifying, at a processor, the data stored in the second computer memory location to effect addition of the prize won by the user to a previously stored value such that the data stored in the second computer memory location represents funds which have been won by the user in playing each of the local game, the linked jackpot game, and the stake-based game rather than data indicative of an amount of credit available to the user to be played in the local game; and when the prize is won by the user, operating the processor to modify the data in the second computer memory location to augment the value of the funds won by the user by the prize won by the user;

making available at least a first portion of the funds won by the user that are stored in the second computer memory location as a stake in the stake-based game, and transferring at least a second portion of the funds won by the user that are stored in the second computer memory location and are not available as the stake in the stake-based game to a credit meter.

10. The method according to claim 9, further comprising:

modifying the data indicative of the amount of credit available to the user to be played in the local game in response to the prize won by the user in the linked jackpot game.

11. The method according to claim 9, further comprising:

modifying the data indicative of the amount of credit available to the user to be played in the local game in response to the prize won by the user in the local game.

12. The method according to claim 9, further comprising:

offering the stake-based game periodically, at random intervals, in response to the occurrence of a predetermined event, or at an interval determined in dependence upon the value of funds won by the user.

13. The method according to claim 12, further comprising:

modifying the data indicative of the amount of credit available to the user to be played in the local game in response to the prize won by the user in the stake-based game.

14. The method according to claim 12, further comprising:

receiving a stake-based game message indicative of a desire of the user to use at least a portion of the funds won by the user as the stake for the stake-based game; and communicating with the stake-based game controller in response to the stake-based game message to cause the stake-based game controller to provide the stake-based game using the stake.

15. The method according to claim 9, further comprising:

receiving a user indication of a desire to pay out all or a user-selected amount of the funds won by the user; and responding by paying out the funds won by the user, or the user-selected amount of funds won by the user.

16. A gaming machine operable in a gaming system, the gaming machine comprising:

a primary logic module configured to provide a local game, wherein a user is enabled to participate in the local game, a linked jackpot game provided by a linked jackpot controller, and a stake-based game provided by a stake-based game controller;

a credit meter configured to store data indicative of an amount of credit available to the user for play on the local game;

a prize message receiver configured to receive a message from each of the primary logic module, the linked jackpot controller, and the stake-based game controller when it is determined that the user has won a prize in each of the local game, the linked jackpot game, and the stake-based game, wherein the prize message receiver is further configured to extract, from the received message, data indicative of the prize won by the user;

a won funds meter configured to store data indicative of a value of funds won by the user; and a processor configured to modify the data stored in the won funds meter to effect addition of the prize won by the user to a previously stored value, such that the won funds meter represents funds which have been won by the user in playing each of the local game, the linked jackpot game, and the stake-based game rather than funds which have been added to the credit meter;

wherein at least a portion of the funds won by the user corresponding to the data stored in the won funds meter is available as a stake in the stake-based game, and wherein any remainder of the funds won by the user is transferred to the credit meter.

17. The gaming machine according to claim 16, wherein the won funds meter is located on a network interface card associated with the gaming machine.

18. The gaming network according to claim 16, wherein the gaming machine is from among a plurality of gaming machines, the plurality of gaming machines being communicatively coupled to a centralised linked jackpot game controller configured to provide a linked jackpot game having a linked jackpot game prize, the linked jackpot game controller being, configured to determine which gaming machines from among the plurality of gaming machines have won the linked jackpot game prize and to output a linked jackpot game prize message to the winning gaming machines indicating a quantum of the linked jackpot game prize.

19. The gaining network according to claim 18, wherein the winning gaming machines are configured to respond to the linked jackpot game prize message by modifying the data indicative of the value of the funds won by the user.

20. The gaming network according to claim 16, wherein the stake-based game controller is configured to offer the stake-based game to the user of a gaining machine, from among a plurality of gaming machines, storing data indicative of a non-zero amount for the funds won by the user.

21. The gaining network according to claim 18, further comprising:

a respective stake-based game controller associated with and adjacent to each gaming machine from among the plurality of gaming machines.

22. A gaming network, comprising:

a plurality of gaming machines configured to enable a plurality of users to participate in a local game provided by the plurality of gaming machines, a linked jackpot game provided by a linked jackpot controller, and a stake-based game provided by a stake-based game controller, the plurality of gaming machines including:

a plurality of credit meters configured to store data indicative of credit available to the plurality of users to be played on the local game, wherein prizes won on the local game are added to the plurality of credit meters; and a plurality of won funds meters configured to store data indicative of funds communicated to the plurality of gaming machines by the linked jackpot controller;

the linked jackpot game controller being in communication with the plurality of gaming machines to provide the linked jackpot game having a linked jackpot game prize, the linked jackpot game controller being configured to determine a set of gaming machines from among the plurality of gaming machines and to modify the plurality of won funds meters of the set of gaming machines so as to share the linked jackpot game prize amongst the set of gaming machines; and the stake-based game controller being configured to offer the stake-based game to users of the set of gaming machines, wherein the stake-based game is played using a stake derived from the plurality of won funds meters of the set of gaming machines, wherein funds stored in the plurality of won funds meters of the set of gaming machines that are not used as the stake in the stake-based game are transferred to the plurality of credit meters of the set of gaming machines, and wherein the stake-based game includes an option allowing a user, from among the plurality of users, corresponding to a gaming machine within the set of gaming machines to offer a bet to users from among the plurality of users, corresponding to other gaming machines from among the plurality of gaining machines.

23. The gaming network according to claim 22, wherein the linked jackpot game controller is configured to determine the set of gaming machines as gaming machines, from among the plurality of gaming machines, that participated in the linked jackpot game.

24. The gaming network according to claim 22, wherein the linked jackpot game controller is configured to determine the set of gaming machines as being currently active gaining machines from among the plurality of gaming machines at a time of an award of the linked jackpot game prize.

25. The gaming network according to claim 22, wherein the other gaming machines comprise:

remaining gaming machines within the set of gaming machines.

26. The gaming network according to claim 22, wherein a stake for the bet is provided by all or a portion of the funds indicated by a won funds meter from among the plurality of won funds meters, corresponding to the gaming machine within the set of gaming machines.

27. The gaming network according to claim 22, wherein a stake for the bet is provided by all or a portion of the linked jackpot game prize.

28. A method of operating gaming machine hardware, the method comprising:

operating a plurality of gaming machines configured to enable a plurality of users to participate in a local game provided by the plurality of gaming machines, a linked jackpot game provided by a linked jackpot controller, and a stake-based game provided by a stake-based game controller, the plurality of gaming machines including:

a plurality of credit meters configured to store data indicative of credit available to the plurality of users to he played on the local game, wherein a prize won on the local game is added to the plurality of credit meters; and a plurality of won funds meters configured to store data indicative of funds communicated to the plurality of gaming machines by the linked jackpot controller;

wherein the plurality of gaming machines is communicatively connectable to a central controller for the provision of Hall the linked jackpot game;

operating the central controller to determine a set of winning gaming machines from among the plurality of winning gaming machines and to share a linked jackpot game prize amongst the set of winning gaming machines, such that the set of winning gaming machines receives a share of the linked jackpot prize; and operating the central controller to provide an option to the set gaming machines to participate in the stake-based game using their share of the linked jackpot game prize as a stake;

transferring funds stored in won funds meters, from among the plurality of won funds meters, corresponding to the set of winning gaming machines that are not used as the stake in the stake-based game to credit meters, from among the plurality credit meters, corresponding to the set of winning gaming machines; and allowing a user from among the plurality of users corresponding to a gaming machine within the set of winning gaming machines to offer a bet to other users, from among the plurality of users, corresponding to other gaming machines from among the plurality of gaming machines.

29. The method according to claim 28, wherein the allowing comprises:

allowing the user to offer the bet to other users from among the plurality of users, corresponding to other gaming machines within the set of winning gaming machines.

* * * * *

UNITED STATES PATENT AND TRADEMARK OFFICE

CERTIFICATE OF CORRECTION

PATENT NO. : 9,033,789 B2
APPLICATION NO. : 12/083860
DATED : May 19, 2015
INVENTOR(S) : Cowan et al.

It is certified that error appears in the above-identified patent and that said Letters Patent is hereby corrected as shown below:

On the Title page, item 73, Assignee, please replace "Paltronics Australia PTY Limited" with --Paltronics Australasia PTY Limited--

In the Claims
Column 14, line 14, please replace "prize on by" with --prize won by--
Column 14, line 22, please replace "stake-based game the" with --stake-based game, the--
Column 14, line 53, please replace "gaining" with --gaming--
Column 16, line 28, please replace "being, configured" with --being configured--
Column 16, line 33, please replace "gaining" with --gaming--
Column 16, line 39, please replace "gaining" with --gaming--
Column 16, line 42, please replace "gaining" with --gaming--
Column 17, line 20, please replace "gaining" with --gaming--
Column 17, line 28, please replace "active gaining" with --active gaming--
Column 17, line 37, please replace "meter from" with --meter, from--
Column 18, line 8, please replace "users to he" with --users to be--
Column 18, line 16, please replace "provision of Hall the linked" with --provision of the linked--
Column 18, line 21, please replace "machines, such" with --machines such--
Column 18, line 41, please replace "users from" with --users, from--

Signed and Sealed this
Twenty-second Day of September, 2015

Michelle K. Lee

Michelle K. Lee
*Director of the United States Patent and Trademark Office*